US006260849B1

(12) United States Patent
Vanhee

(10) Patent No.: US 6,260,849 B1
(45) Date of Patent: Jul. 17, 2001

(54) GAME AND APPARATUS FOR PLAYING A GAME

(76) Inventor: Chris Vanhee, Rozenhof 67, St. Eloois Vijve B-8793 (BE)

( * ) Notice: Subject to any disclaimer, the term of this patent is extended or adjusted under 35 U.S.C. 154(b) by 0 days.

(21) Appl. No.: 09/230,591

(22) PCT Filed: Jul. 28, 1997

(86) PCT No.: PCT/EP97/04163

§ 371 Date: Apr. 26, 1999

§ 102(e) Date: Apr. 26, 1999

(87) PCT Pub. No.: WO98/05395

PCT Pub. Date: Feb. 12, 1998

(30) Foreign Application Priority Data

Aug. 2, 1996 (BE) ..... 9600679

(51) Int. Cl.[7] ..... A63F 1/02

(52) U.S. Cl. ..... 273/293; 273/153 R; 273/156; 273/308; 273/236

(58) Field of Search ..... 273/292, 293, 273/308, 153 R, 236, 156

(56) References Cited

U.S. PATENT DOCUMENTS 2,634,132 * 4/1953 Freeman .
3,245,687 * 4/1966 Irwin .
3,263,999 * 8/1966 McCoy .
4,140,320 * 2/1979 Cortimilia .
4,671,515 * 6/1987 Burgess .

* cited by examiner

*Primary Examiner*—Benjamin H. Layno
*Assistant Examiner*—Vishu Mendiratta
(74) *Attorney, Agent, or Firm*—James Crieghton Wray; Meera P. Narasimhan

(57) ABSTRACT

A game, comprising a number of elements (2, 3, 4, 10, 11, 12) with at least one nontransparent zone (7, 14) and at least one opening (5, 13) or transparent zone, which are so made that by forming a pile of at least two elements (2, 3, 4, 10, 11, 12) a predetermined figure can be made visible, characterised in that the predetermined figure can be formed by the overlapping (parts of) openings (5, 13) or transparent zones of the elements of a pile. A playing apparatus, comprising a screen and means for selecting elements (2, 3, 4, 10, 11, 12) one after another, provided for obtaining a predetermined figure on the screen through a suitable selection of elements, and provided for playing a game that is based on the principle of the game according to this invention.

20 Claims, 2 Drawing Sheets

2

GAME AND APPARATUS FOR PLAYING A GAME

BACKGROUND OF THE INVENTION

This invention relates to a game, comprising a number of elements with at least one nontransparent zone, and at least one opening or transparent zone, which are so made that by forming a pile of at least two elements a predetermined figure can be made visible.

Such a game is described in the U.S. Pat. No. 4,140,320. This game comprises several cards, with a surface that is divided into sections, of which one section is nontransparent and is provided with a nontransparent symbol, while a transparent zone is provided in all other sections. The cards differ from each other by the location of the nontransparent section with the symbol. If two cards are placed on top of one another, the symbol of the lower card is visible through a transparent zone of the upper card. By forming a pile of cards a predetermined figure can be made visible with the nontransparent symbols of the piled-up cards.

The game that is described in the Belgian patent no. 703 260 is based on the same principle. This game comprises a number of cards made of a transparent material, on which nontransparent zones are provided. A part of a figure is represented on each card by means of the nontransparent zone(s), so that the whole figure can be made visible by laying the cards on top of one another.

The object of the above described known games is in each case to obtain a predetermined figure, by laying several cards on top of one another, by which the different parts of this figure are represented in the correct place. The only skill that is required for that purpose is recognising the shape and the location, or only the location (in the case of the game according to U.S. Pat. No. 4,140,320), on the surface that is occupied by the various parts of the figure on the individual cards. Most people (with the exception of children) have little difficulty with this.

In order to bring some excitement into the course of the game, the game must be so played that the players cannot have all the cards available at all times. So the rules of the game are therefore that through luck a player comes into possession of a card that can be used for forming a predetermined figure. So for most players it is especially the "luck" factor, and only to a very limited degree their skill that determines the results of their play.

The more this game is played, the quicker the cards required for forming a predetermined figure will be recognised. The "luck" factor therefore increases in significance all the more, the better the game is known. After a time most people will therefore no longer find any challenge in these games.

With another game, which is described in the U.S. Pat. No. 4,671,515, there is a first type of nontransparent cards on which individual symbols are represented, and a second type of cards with a nontransparent zone and a transparent zone with the shape of a number or a letter. If a card of the second type is laid on top of a card of the first type, a number of the individual symbols of the lower card are visible through the transparent zone of the upper card. A card of the first type and a card of the second type belong together if a number of predetermined symbols are visible while these cards lie one on top of the another. An object of this game consists in obtaining a matching card of the second type for a number of cards of the first type.

With the game described in the preceding paragraph it must be determined whether or not a number of symbols on a card of the first type correspond to a location on which a card of the second type is provided with a transparent zone. With this game no predetermined figure has to be formed by the players. The only figure that comes into it, is the figure that is formed by the transparent zone of each card of the second type.

Just as with the above described games, this game only requires the skill to recognise the location of a surface that is occupied by a nontransparent symbol on another card, and therefore also has the above described disadvantages.

This invention also relates to an apparatus for playing a game, comprising a screen and means for selecting elements one after another, provided for obtaining a predetermined figure on the screen through a suitable selection of elements.

SUMMARY OF THE INVENTION

A first object of this invention is to provide a game with the characteristics indicated in the first paragraph of this description, which can be so made that it requires a great skill from players of all ages, so that the results of play are not principally determined by luck, and which even with experienced players signifies a continual challenge and consequently remains absorbing and retains its appeal.

A second object of this invention is to provide an original apparatus for playing a game, whereby the apparatus has the above mentioned characteristics, and also has the advantageous attributes indicated in the preceding paragraph.

The first object of this invention is achieved by providing a game with the characteristics indicated in the first paragraph of this description, but whereby the predetermined figure can be formed by the overlapping (parts of) openings or transparent zones of the elements of a pile.

The nontransparent zones of the individual elements are not parts of the predetermined figure. The elements that are required for forming that figure can therefore not be recognised through the location or the shape of the surface occupied by their nontransparent zone(s).

Since each element comprises one or several (parts of) openings or transparent zones, which cannot be used for forming the predetermined figure the required elements can also not be recognised from the location or the shape of the surface occupied by their transparent zone(s).

The task can furthermore be made more difficult by in each case providing a (part of a) nontransparent zone in corresponding locations of two or more elements, with which a predetermined figure can be formed. These (parts of) transparent zones overlap one another when forming a pile. Because of this it will be avoided that players will recognise too quickly which elements have nontransparent zones which together form a figure that complements the predetermined figure.

From the above it appears that this game can be so made that it requires especially great understanding and skill from most players. The (parts of) openings or transparent zones with which a figure can be formed and the (parts of) nontransparent zones with which a complement to the predetermined figure can be formed, are very difficult to recognise as such so that even after playing this game frequently it remains a very difficult task to identify the elements that are necessary for obtaining a predetermined figure. Playing this game consequently remains a challenge and an absorbing pastime. The results of play, irrespective of the rules of the game, are chiefly determined by the skill of the players. The game can be so made that it fulfills the capacities of young players or of expert adult players, and has the above enumerated advantages for every type of player.

The second object of this invention is achieved by providing a playing apparatus, comprising a screen and means for selecting elements one after another, provided for obtaining a predetermined figure on the screen through a suitable selection of elements, whereas on every selectable element at least one first zone and at least one second zone can be distinguished; whereas the apparatus is equipped for showing a top view on the screen of a fictitious piling-up of the selected elements on a base surface, whereby the aforementioned first and second zones are considered respectively as nontransparent zones and transparent zones of these elements; and whereas the predetermined figure can be formed on the screen by the representation of each part of the base surface that is situated under the overlapping (parts of) transparent zones of the elements of the pile under consideration.

The game that can be played with this apparatus is based on the new principle of the game according to this invention and consequently has the same advantageous attributes as this game.

In a particularly advantageous embodiment of the game according to this invention the elements are so made that several predeterminable figures can be made visible by forming respective piles of at least two elements.

In a particularly advantageous embodiment of the playing apparatus, which corresponds to the embodiment of the game from the preceding paragraph, the apparatus is equipped for obtaining several predeterminable figures on the screen, by producing respectively suitable selections of elements.

The task of the player(s) can for example consist of forming a combination of several predetermined figures, whereby the combination itself also has to form a predetermined figure.

In a preferred embodiment the game comprises a basic element with a surface on which elements can be piled up in order to make the figure formed by a pile visible by means of every zone of this surface that is visible through the overlapping (parts of) openings or transparent zones of these elements, whereas several zones are indicated on the aforementioned surface, so that the location of every opening or transparent zone of every element corresponds to the location of a zone indicated on the base element.

With such a base element the figure obtained is always clearly observable. Furthermore after adding each element to the pile it can be clearly seen which zones still have to be covered in order to obtain the predetermined figure. This makes the game more orderly. The indication of the aforementioned zones on the base element preferably occurs by giving these zone a colour which contrasts well with the colour of the nontransparent zones of the elements.

In a preferred embodiment the playing apparatus, this apparatus is equipped for representing the aforementioned base surface on the screen with indication of several zones, so that each second zone of every selectable element corresponds with a zone on the base surface.

The advantages of this are the same as the advantages of the zone indications on the base element.

In another preferred embodiment the game comprises a base element with a surface on which elements can be piled up in order to make the figure formed by a pile visible by means of every zone of this surface that is visible through the overlapping (parts of) openings or transparent zones of these elements, whereas at least one zone is recognisable on the aforementioned surface in order during play to be considered as a zone of the surface which is already covered by a nontransparent zone of an element.

Because of this it is possible that a player has a base element available, with which the predetermined figure cannot be made visible, because one or several of the zones required for that purpose has to be considered as a zone that is already covered by a nontransparent zone of an element. The rules of the game determine what must occur in such a situation.

The same possibilities are provided with a playing apparatus that is equipped for representing at least one zone of the aforementioned base surface on the screen as a zone that is covered by a nontransparent zone of an element.

The game can comprise two or more base elements, of which the respective surfaces differ from each other by the location and/or the number of the zones that have to be considered as covered zones. The rules of the game can for example provide that an unusable base element may under specific conditions (e.g. payment) be replaced by another base element.

In a preferred embodiment the game is equipped for making a predetermined figure visible by forming a pile of elements on top of a base element, whereas the game comprises a game element with at least one nontransparent zone, which is provided in order to be considered as (a part of) the base surface, and whereas the aforementioned game element is provided in order to be so laid on an element or on a pile of elements that a part of the base surface covered by one or several elements has again to be considered as an uncovered part of the base surface.

By providing the game with one or several such additional game elements the game is made even more absorbing. A player can indeed bring about a thorough alteration to the situation of play already reached by a pile of elements, by laying such a game element on the pile, and ensuring that parts of the base surface that were already covered by one or several elements of the pile, have again to be considered as uncovered parts.

According to a variant of the embodiment of the game it can be provided that the figures to be formed must consist of different well-defined colours. The game element mentioned in the previous paragraph can then for example be provided for altering the colour(s) made visible in one or several locations by a pile of elements.

The same possibilities are provided with a playing apparatus according to the invention, which comprises a selectable game element, on which at least one zone can be distinguished, which after selection of the game element is considered as (a part of) the base surface, so that the game element can be so selected that a part of the base surface represented as covered is again represented as an uncovered part of this base surface.

With a particular embodiment of the game it is indicated on the nontransparent zone(s) of every element where the openings or transparent zones of all other elements are.

The elements are preferably so made that one or several numbers or letters can be made visible.

In the most preferred embodiment of the game the elements are cards or boards.

This invention also relates to a method for playing a game, making use of the above described game or playing apparatus, whereby a number of elements are so piled up that a predetermined figure is formed by the overlapping (parts of) openings or transparent zones of these piled-up elements.

The invention will now be further explained in the following description in which reference is made to the figures attached hereto:

DETAILED DESCRIPTION

Figure 1:
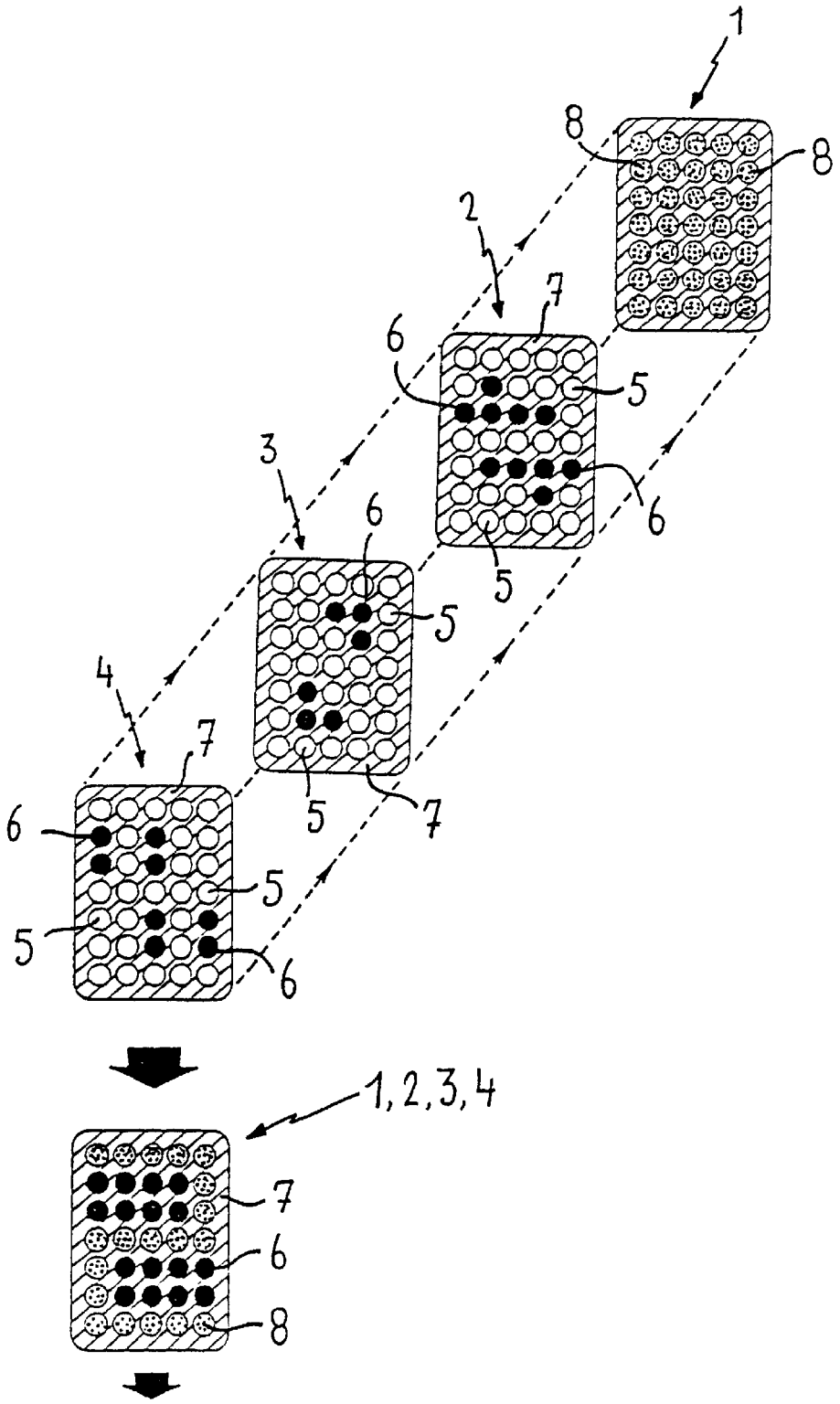
FIG. 1 represents a view from above of a base card, of three playing-cards, and of the pile that is formed with these playing-cards on the base card in order to form a predetermined number.

In a preferred embodiment the game according to this invention (see FIG. 1) comprises a base card (1) and several playing-cards (2), (3), (4), of which only three are represented in FIG. 1. All playing-cards (2), (3), (4) and the base card (1) have the same principally rectangular shape and the same measurements, and are made out of a nontransparent material.

Each playing-card (2), (3), (4) has several openings (5) and a nontransparent zone (7), on which zones (6) are indicated coloured in black. Both the openings (5) and the black coloured zones (6) are circular with almost the same diameters. The number and the location of these black coloured zones (6) and of the openings (5) is such on each card that the aforementioned zones (6) and openings (5) together occupy all locations of 7 rows of 5 places situated under one another. The playing-cards (2), (3), (4) differ from each other by the location or the number of the openings (5) and of the aforementioned zones (6).

In the base card (1) 35 zones (8) are indicated with a colour which contrasts well with the colour of the nontransparent material of the playing-cards (2), (3), (4). These zones (8) are circular with almost the same diameters as the aforementioned openings (5) and black coloured zones (6), and are disposed in 7 rows of 5 zones (8) situated under one another. The location of each opening (5) of every playing-card (2), (3), (4) of the game moreover corresponds with the location of a zone (8) indicated on the base card (1).

The black coloured zones (6) on each playing-card (2), (3), (4) in each case indicate where the openings (5) of all other playing-cards are.

By laying the playing-cards (2), (3), (4) on top of one another on the base card (1), a predetermined number—the number "two"—is formed by the overlapping openings (5) of the playing-cards (2), (3), (4), and this number is made clearly visible by means of the zones (8) of the base card (1) that are visible through the overlapping openings (5) of the playing-cards (2), (3), (4).

In another embodiment (see claim 5) the game comprises playing-cards (10), (11), (12) with one or several elongated openings (13), and a nontransparent zone (14), on which one or several elongated zones (15) are indicated coloured in black. On every playing-card (10), (11), (12) the elongated openings (13) and zones (15) together form the number "eight" in the manner that is among others used with digital watches. The playing-cards (10), (11), (12) differ from each other by the location or the number of the elongated openings (13) and of the elongated zones (15).

The game comprises several base cards (16), (17) on which zones (18), (19) are indicated, which represent the number "eight" in digital manner, so that the location of each opening (13) on every playing-card (10), (11), (12) of the game corresponds with the location of a zone (18), (19) indicated on the base cards (16), (17).

Figure 5:
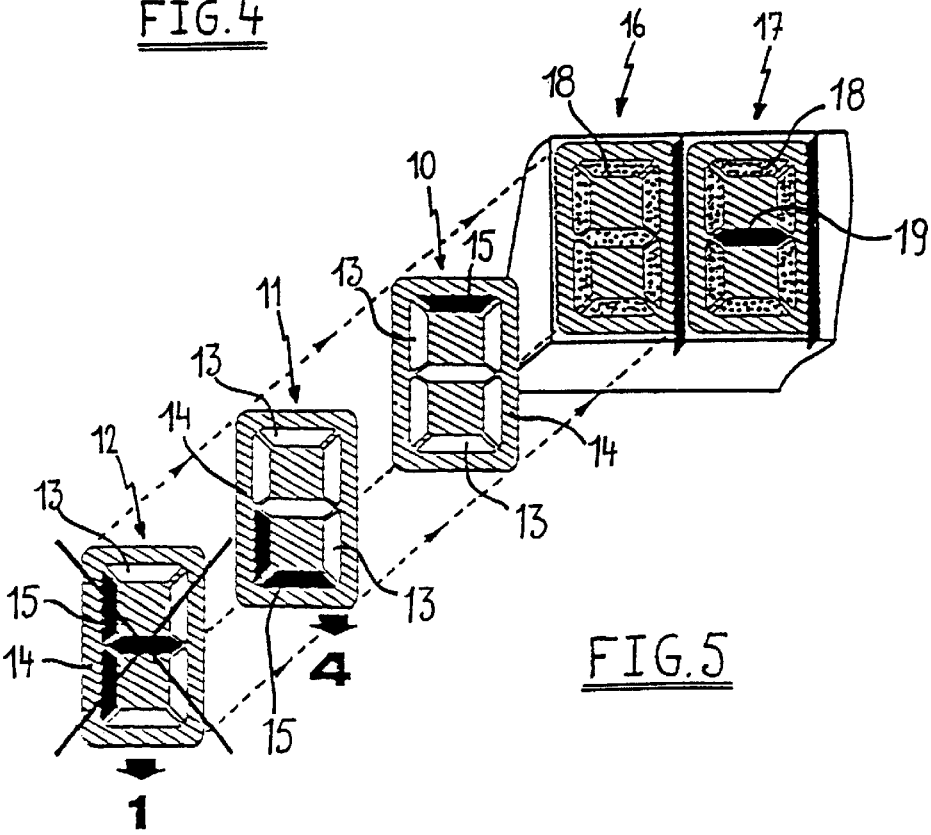
FIG. 5 represents in perspective a part of a holder with two base cards, and three playing-cards of which the crossed-out playing-card according to the rules of the game cannot be added to the pile.

Two playing-cards (10), (11) are laid on the base card (16) represented on the left in FIG. 5 in order to form the predetermined number "four". By adding a playing-card (12) to the pile the number "one" can be obtained. In the rules of the game it is however specified that a black coloured zone (15) of a playing-card (10), (11), (12) may never be covered by another playing-card (10), (11), (12). Adding the last playing-card (12) is therefore in this case not permissible.

On the base card (17) represented on the right in FIG. 5 one of the indicated zones (19) is coloured in black, while the other indicated zones (18) have another colour. When playing the black coloured zone (19) on the base card (17) must be considered as a zone that has already been covered by a playing-card (10), (11), (12).

Figure 2:
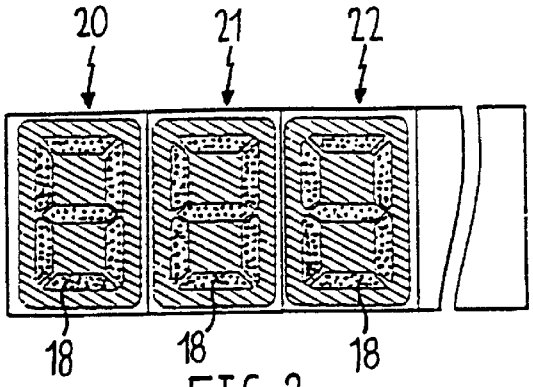
FIGS. 2 and 3 represent a view from above of a first and a second series of three base cards of a game.
Figure 3:
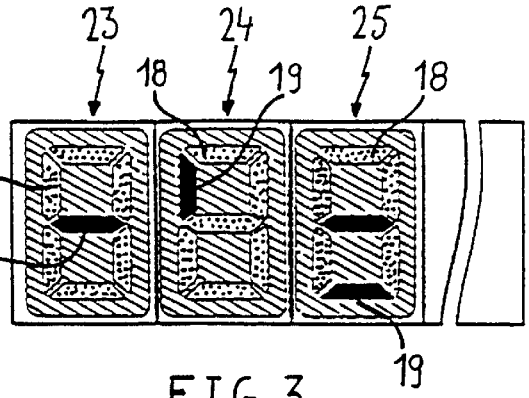

In FIGS. 2 and 3 a first and a second series of three base cards (20), (21), (22); (23), (24), (25) is respectively represented for this game. The base cards (20), (21), (22) from FIG. 2 are identical to the base card represented on the left in FIG. 5. The base cards (23), (24), (25) from FIG. 3 are provided with one or several black coloured zones (19), and differ from each other by the location and/or the number of these zones (19).

Figure 4:
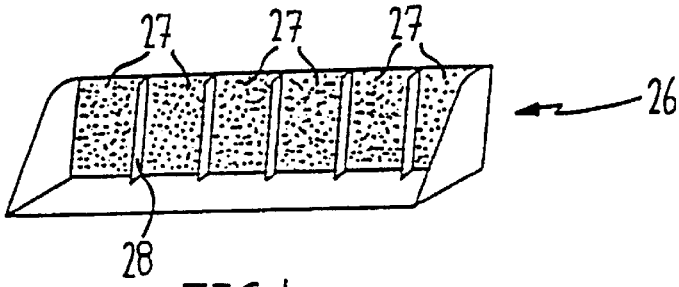
FIG. 4 is a perspective drawing of a holder for six piles of playing-cards.

In FIG. 4 a holder (26) for 6 piles of playing-cards (10), (11), (12) is represented. A coloured surface (27) is provided for each pile, in order to make clearly visible the opening(s) (13) of a first playing-card (10), (11), (12) of the respective piles, or the figure formed by a respective pile. The surfaces (26) are separated from each other by an upright wall (28).

The object of a game according to this invention can consist of obtained a predetermined (e.g. by means of dice) combination of letters and/or numbers. Every number and every letter of the combination must moreover be formed by a separate pile of cards. The different piles can be placed next to one another in one and the same holder (26).

The game can for example be played by 2 or more players as follows:

Each player starts with the same number of playing-cards and in turn lays a playing-card on the base card or on a fully coloured surface, whereby the players together form a number of piles that are equal to the number of letters and/or numbers of the predetermined combination.

If a player can no longer lay down a card for example because of the rules of the game that a black coloured zone of a playing-card may not be covered any more by another playing-card), this player may no longer be part of the game. The winner is the one who either remains the last in the game, or who is the first to obtain the predetermined combination.

Different point values or monetary values can also be assigned to the various playing-cards. The value of each card can for example be indicated by the colour of the card. By also making up rules of the game with regard to these values, the game can be made even more absorbing.

What is claimed is:

1. Game, comprising a number of elements (2, 3, 4), (10, 11, 12) with at least one nontransparent zone (7), (14), and at least one opening (5), (13) or transparent zone, which are so made that by forming a pile of at least two elements (2, 3, 4), (10, 11, 12) a predetermined figure can be made visible, characterised in that the predetermined figure is formed by the overlapping openings (5), (13) or transparent zones of the elements of a pile.

2. Game, according to claim 1, characterised in that the elements (2, 3, 4), (10, 11, 12) are so made that several predeterminable figures can be made visible, by forming respective piles of at least two elements.

3. Game, according to claim 1, characterised in that it comprises a base element (1), (16, 17, 20–25) with a surface on which elements (2, 3, 4), (10, 11, 12) can be piled up in order to make the figure formed by a pile visible by means of every zone of this surface that is visible through the overlapping openings (5), (13) or transparent zones of these elements (2, 3, 4), (10, 11, 12); and that several zones (8), (18) are indicated on the aforementioned surface, so that the location of every opening (5), (13) or transparent zone of every element (2, 3, 4), (10, 11, 12) corresponds to the location of a zone (8), (18) indicated on the base element (1), (16, 17, 20–25).

4. Game, according to claim 1, characterised in that it comprises a base element (17, 23–25) with a surface on which elements (10, 11, 12) can be piled up in order to make the figure formed by a pile visible by means of every zone of this surface that is visible through the overlapping (parts of) openings (13) or transparent zones of these elements (10, 11, 12); and that at least one zone (19) is recognisable on the aforementioned surface in order during play to be considered as a zone of the surface which is already covered by a nontransparent zone (14) of an element (10, 11, 12).

5. Game, according to claim 4, characterised in that it comprises at least two base elements (17, 23–25), of which the respective surfaces differ from each other by the location and/or the number of the aforementioned recognisable zones (19).

6. Game, according to claim 1, characterised in that the game is equipped for making the aforementioned figure visible by forming a pile of elements (2, 3, 4), (10, 11, 12) on top of a base surface; that the game comprises a game element with at least one nontransparent zone, which is provided in order to be considered as the base surface or a part thereof; and that the game element: is provided in order to be so laid on an element (2, 3, 4), (10, 11, 12) or on a pile of elements that a part of the base surface covered by one or several elements has again to be considered as an uncovered part of the base surface.

7. Game, according to claim 1, characterised in that it is indicated on the nontransparent zone(s) (7), (14), of every element (2, 3, 4), (10, 11, 12) where the openings (5), (13) or transparent zones of all other elements (2, 3, 4), (10, 11, 12) are.

8. Game, according to claim 1, characterised in that the elements (2, 3, 4), (10, 11, 12) are so made that one or several numbers or letters can be made visible.

9. Game, according to claim 1, characterised in that the elements (2, 3, 4), (10, 11, 12) are cards or boards.

10. Playing apparatus, comprising a screen and means for selecting elements (2, 3, 4), (10, 11, 12) one after another, provided for obtaining a predetermined figure on the screen through a suitable selection of elements, characterised in that on every selectable element (2, 3, 4), (10, 11, 12) at least one first zone (7), (14) and at least one second zone (5), (13) can be distinguished; that the apparatus is equipped for showing a top view on the screen of a fictitious piling-up of the selected elements (2, 3, 4), (10, 11, 12) on a base surface (1) (16, 17, 20–25, 27), whereby the aforementioned first (7), (14) and second zones (5), (13) are considered respectively as nontransparent zones (7), (14) and transparent zones (5), (13) of these elements; and that the predetermined figure can be formed on the screen by the representation of each part of the base surface that is situated under the overlapping transparent zones (5), (13) of the elements of the pile under consideration.

11. Playing apparatus, according to claim 10, characterised in that several predeterminable figures can be obtained on the screen, by producing respectively suitable selections of elements (2, 3, 4), (10, 11, 12).

12. Playing apparatus, according to claim 10, characterised in that it is equipped for representing the aforementioned base surface on the screen with indication of several zones (8), (18), so that the location of each second zone (5), (13) of every selectable element (2, 3, 4), (10, 11, 12) corresponds with a zone (8), (18) on the base surface.

13. Playing apparatus, according to claim 10, characterised in that it is equipped for representing at least one zone (19) of the aforementioned base surface on the screen as a zone that is covered by a nontransparent zone (7), (14) of an element.

14. Playing apparatus, according to claim 10, characterised in that it comprises a selectable game element, on which at least one zone (5), (13) can be distinguished, which after selection of the game element is considered as the base surface (1), (16, 17, 20–25, 27) or a part thereof, so that the game element can be so selected that a part of the base surface represented as covered is again represented as an uncovered part of this base surface.

15. Game apparatus comprising a number of overlying elements, each element having at least one non-transparent zone, and at least one opening or transparent zone, which are so made that by overlying and forming a pile of at least two elements, the non-transparent zones and the openings or transparent zones of the overlying elements align and overlap in a predetermined arrangement, whereby a predetermined visible figure is made visible, and wherein the predetermined visible figure is formed by the aligned and overlapping openings or transparent zones of the elements forming the pile.

16. Game apparatus according to claim 15, wherein the elements are so made that several predeterminable figures can be made visible by forming respective piles of at least two different elements.

17. Game apparatus according to claim 15, further comprising a base with base zones on a surface on which the overlying elements are formed in the pile for making the predetermined visible figure formed by the base zones of the surface that are visible through the aligned and overlapping openings or transparent zones of the elements in the pile and wherein several of the base zones are indicated on the surface, so that a location of every opening or transparent zone of every element corresponds to a location of a base zone indicated on the surface of the base.

18. Game apparatus of claim 17, wherein the base is a board and the elements are cards.

19. Game apparatus of claim 17, wherein the base and the elements are cards.

20. Game apparatus of claim 15, wherein the elements are cards.

* * * * *